US007090091B2

(12) United States Patent
Richter

(10) Patent No.: US 7,090,091 B2
(45) Date of Patent: Aug. 15, 2006

(54) LARGE VOLUME CONTAINER FOR HOLDING LIQUID MEDIA

(76) Inventor: Günter Richter, Johannistal 12, D-57610 Altenkirchen (DE)

( * ) Notice: Subject to any disclaimer, the term of this patent is extended or adjusted under 35 U.S.C. 154(b) by 349 days.

(21) Appl. No.: 10/717,009

(22) Filed: Nov. 18, 2003

(65) Prior Publication Data

US 2004/0118856 A1 Jun. 24, 2004

Related U.S. Application Data

(63) Continuation-in-part of application No. 10/031,769, filed as application No. PCT/DE00/02196 on Jul. 5, 2000, now abandoned.

(30) Foreign Application Priority Data

Jul. 23, 1999 (DE) ..... 299 12 902 U

(51) Int. Cl.
*B65D 88/76* (2006.01)

(52) U.S. Cl. ..... 220/567.1; 220/560.03; 220/62.11; 220/62.15; 220/62.22; 220/612; 220/613; 220/677; 220/679; 220/678; 220/669; 220/608; 220/609; 220/567.2

(58) Field of Classification Search ..... 220/509, 220/560.03, 62.15, 612, 613, 679, 678, 669, 220/675, 567.1, 567.2, 608, 609
See application file for complete search history.

(56) References Cited

U.S. PATENT DOCUMENTS

| | | | | |
|---|---|---|---|---|
| 3,746,204 | A * | 7/1973 | Nagai | 220/592.2 |
| 5,697,511 | A * | 12/1997 | Bampton | 220/4.12 |
| 6,077,578 | A * | 6/2000 | Valyi | 428/35.7 |
| 6,220,779 | B1 * | 4/2001 | Warner et al. | 403/381 |
| 2002/0053568 | A1 * | 5/2002 | Balzer et al. | 220/4.14 |

* cited by examiner

*Primary Examiner*—Jes F. Pascua
*Assistant Examiner*—Shawn M Braden
(74) *Attorney, Agent, or Firm*—Friedrich Kueffner

(57) ABSTRACT

A large-volume container for holding liquid media is composed of two shell-like end parts each having a ring-shaped flat contact surface, and at least one sleeve-like middle part composed of two ring segments and provided with two ring-shaped flat contact surfaces and an opening for filling and emptying. The two end parts as well as the ring segments of the middle part are manufactured by blow molding with an inner layer and an outer layer, are provided with external stiffening ribs formed as chambers, and are connected in the areas of their contact surfaces by an inner and outer weld. The two end parts as well as the ring segments have in the areas of their contact surfaces a circumferential chamber, wherein the contact surfaces have at their circumferential boundary edges backwardly extending inclinations for forming welding grooves between the end parts and/or the ring segments.

8 Claims, 1 Drawing Sheet

LARGE VOLUME CONTAINER FOR HOLDING LIQUID MEDIA

CROSS-REFERENCE TO RELATED APPLICATIONS

This application is a Continuation-in-Part Application of U.S. patent application Ser. No. 10/031,769 filed Jan. 23, 2002, Now abandoned, which is a national stage of PCT DE00/02196 filed Jul. 5, 2000.

BACKGROUND OF THE INVENTION

1. Field of the Invention

The invention relates to a large-volume container for holding liquid media composed of two shell-like end parts each having a ring-shaped flat contact surface, and a sleeve-like middle part composed of two ring segments, wherein the middle part also has two ring-shaped and flat contact surfaces and an opening for filling and emptying, wherein the two end parts as well as the ring segments of the middle part are manufactured with an inner layer and an outer layer by blow molding, and wherein the end parts and the middle part are provided with external stiffening ribs constructed as chambers and are connected in the areas of their contact surfaces by an inner and an outer welding.

2. Description of the Related Art

As disclosed in applicant's German application DE 198 18 709 A1, a device for storing and for transporting liquid media has become known which is composed of a large-volume container composed of at least two parts which are connected by welding. Each part is manufactured by blow molding and has an inner wall and an outer wall connected on all sides to the inner wall, wherein the inner wall is essentially flat and the outer wall has stiffening ribs formed by chambers between the inner wall and the outer wall. The parts to be connected have ring-shaped and flat contact surfaces through which the parts are connected to each other by an inner and an outer welding seam. Because of the configuration of the parts in the areas of the contact surfaces, the welding connection is extremely problematic and the desired connection is not always achieved in a satisfactory manner.

SUMMARY OF THE INVENTION

Therefore, the invention is based on the object of further developing a known large-volume container of this type in such a way that an optimum welded connection can be achieved and the container has a sufficient strength and stability, particularly in the connection area, even in the case of an especially large volume.

For meeting the above object, the invention proposes in a container of the above-described type to provide the two end parts as well as the ring segments in the areas of their contact surfaces with a circumferential chamber, wherein the contact surfaces have at their circumferential boundary edges backwardly extending inclinations for forming weld channels between the end parts and/or ring segments.

As a result of this configuration of the end parts and the ring segments, an especially good connection between these parts is achieved, so that the container has a good strength and stability, especially also when it has a volume above 1000 l. Moreover, such a container has an especially good appearance even in the area of its welding seams.

The invention will be explained in more detail below in connection with an embodiment illustrated in a drawing.

DESCRIPTION OF THE PREFERRED EMBODIMENTS

Figure 1:
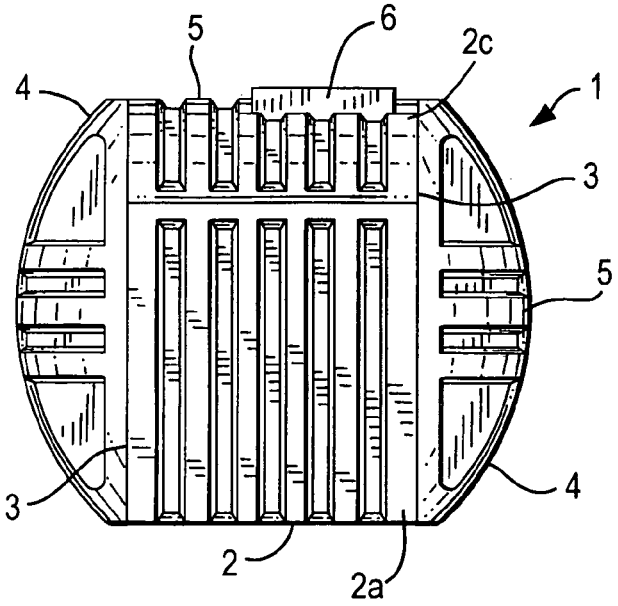
FIG. 1 is an elevational view of a container according to the invention.
Figure 2:
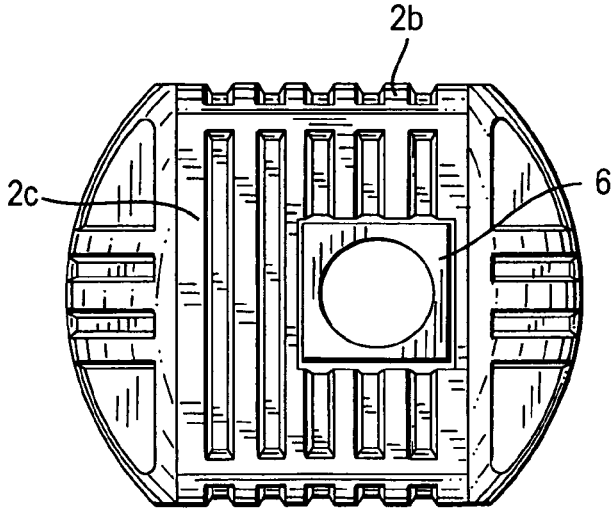
FIG. 2 is a top view of the container in FIG. 1.

FIGS. 1 and 2 of the drawing show a large-volume container 1 which serves for storing liquid media, for example, for holding rain water. This container 1, which may have an internal volume of about 3.0 to 4.0 m3, is made of plastics material and, in the illustrated embodiment, is formed of a hollow middle part 2 with an approximately circular cross-section which forms a closed container 1 together with a trough-like or shell-like end part 4 at each of the two end faces 3. In the illustrated embodiment, the middle part 2 itself is also composed of three ring segments 2*a*, 2*b*, 2*c*. The ring segments 2*a*, 2*b*, 2*c* as well as the two end parts 4 are connected tightly and sealingly to each other by welding.

FIGS. 1 and 2 further show that all three ring segments 2*a*, 2*b*, 2*c* and the two end parts 4 have stiffening ribs 5 which may have approximately the same cross-section, but may be formed with different lengths. Moreover, the Figures show that a dome-shaped portion 6 is formed on the upper ring segment 2*c* of the middle part 2. Provided in the lower area of the ring segments 2*a* and 2*b* may be legs which are either integrally connected to the ring segments 2*a*, 2*b* or are attached separately. If necessary, these legs may be omitted or arranged or formed at an end part 4.

The inner side of the container 1 and, thus, the inner sides of the ring segments 2*a*, 2*b*, 2*c* and the end parts 4 have a completely smooth surface which, however, is adapted to the contour of the container 1, while the stiffening ribs 5 are only provided at the outer wall surface or surfaces. These outer stiffening ribs 5 provide the container 1 with a high stability, even if it has a relatively large volume, while the smooth inner surface ensures that no dirt can deposit in recesses. This also ensures an easy cleaning of the container 1.

Figure 3:
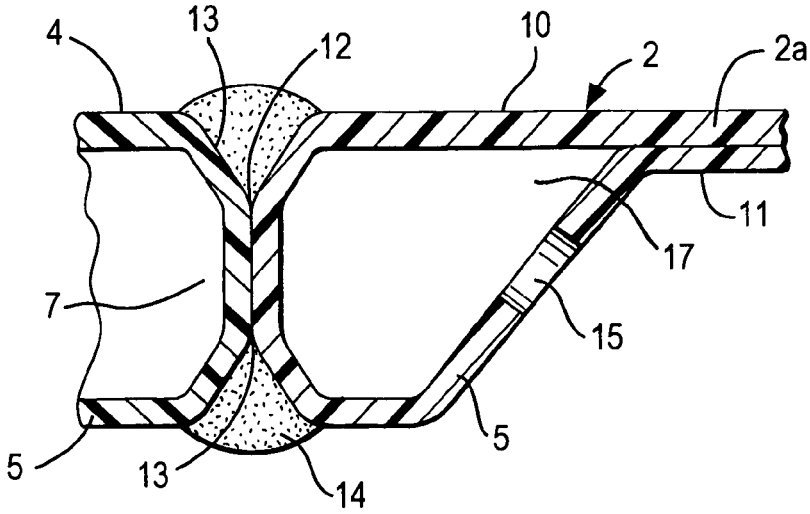
FIG. 3 is a sectional view of a connecting area between an end part and a middle part composed of at least two ring segments.

As can be seen in FIG. 3, the stiffening ribs 5 are formed by chambers 7 which are produced when the end parts 4 and the ring segments 2*a*, 2*b*, 2*c* are manufactured by a so called blow molding method. In this method, a hose-like preform is manufactured in the conventional manner from a molten thermoplastic material and is moved into a blow mold which is composed, for example, of two mold halves and has a mold cavity corresponding to the outer shape of the ring segments 2*a*, 2*b*, 2*c* and of the end parts 4. After the blow mold has been closed, air is blown into the preform in the blow mold, so that the preform is pressed into contact with the inner wall of the mold cavity of the blow mold. The ring segments 2*a*, 2*b*, 2*c* and the end parts 4 have an inner wall 10 and an outer wall 11 which partially rest tightly against each other and are only separated in the area of the stiffening ribs 5 by the chamber 7. In those areas in which the inner wall 10 and the outer wall 11 rest against each other, a type of welding of these layers takes place, so that a particularly stable wall is achieved. FIG. 3 also shows that the chambers 7 and, thus, the stiffening ribs 5, are exclusively formed by the outer wall 11 and the inner wall 10 is not subjected to deformation or not to significant deformation.

The chambers 7 illustrated in FIG. 3 belong to an end part 4 and a ring segment 2*a* of the middle part 2, wherein these chambers 7 form contact surfaces 12 which contact each other through the end part 4 and the ring segment 2*a*. In accordance with the invention, the chambers 7 are constructed so as to extend circumferentially and, thus, are also located in those areas in which the ring segments 2*a*, 2*b*, 2*c* of the middle part 2 are connected to each other. These contact surfaces 12 which are as flat as possible and extend in the shape of a ring in the end parts 4 and the assembled middle part 2, extend at their circumferential boundary edges into inclinations 13, so that a V-shaped welding groove 14 is formed at each of two oppositely located sides between the end part 4 and the middle part 2. These inclinations 13 extend at an angle of about 15 to 45 degrees.

FIG. 3 also shows that the inner wall 10 is constructed thicker than the outer wall 11. This can be achieved by an appropriate control of the extrusion process. The so called blow opening 15 is always located in the outer wall 11. This results in the advantage that the blow opening 15, for example, after removal of a blow connection, does not have to be closed. A flowable material, for example, concrete, can be filled or cast through this blow opening 15 into the chambers 7 of the ring segments 2*a*, 2*b*, 2*c* and of the end parts 4, so that the stability of the container 1 is improved. The inner layer 10 of the ring segments 2*a*, 2*b*, 2*c* and of the end parts 4 may advantageously be composed of a foamable plastics material, particularly an open-pore plastics material.

I claim:

1. Large-volume container for holding liquid media, composed of two shell-like end parts each having a ring-shaped flat contact surface, and at least one sleeve-like middle part composed of two ring segments and provided with two ring-shaped flat contact surfaces and an opening for filling and emptying, wherein the two end parts as well as the ring segments of the middle part are manufactured by blow molding with an inner layer and an outer layer, are provided with external stiffening ribs formed as chambers, and are connected in the areas of their contact surfaces by an inner and outer weld, wherein the two end parts (4) as well as the ring segments (2*a*, 2*b*, 2*c*) have in the areas of their contact surfaces (12) a circumferential chamber (7), wherein the contact surfaces (12) have at their circumferential boundary edges backwardly extending inclinations (13) for forming welding grooves (14) between the end parts (4) and the ring segments (2*a*, 2*b*, 2*c*).

2. Container according to claim 1, wherein the inclinations (13) extend at an angle of about 15 to 45 degrees.

3. Container according to claim 1, comprising blow openings (15) for the end parts (4) as well as for the ring segments (2*a*, 2*b*, 2*c*) formed in outer layers (11) thereof.

4. Container according to claim 1, wherein the inner layer (10) of the end parts (4) and of the ring segments (2*a*, 2*b*, 2*c*) has a greater thickness than the outer layer (11).

5. Container according to claim 4, wherein the inner layer (10) is formed of a foamable plastics material.

6. Container according to claim 5, wherein the inner layer (10) is formed of an open-pore plastics foam.

7. Container according to claim 1, wherein at least a portion of the chambers (7) of the end parts (4) and the ring segments (2*a*, 2*b*, 2*c*) are filled with a flowable material.

8. The container according to claim 7, wherein the flowable material is concrete.

* * * * *